United States Patent [19]

Shaddock

[11] Patent Number: 4,764,180

[45] Date of Patent: Aug. 16, 1988

[54] METHOD OF MANUFACTURING JET NOZZLES

[76] Inventor: Roland E. Shaddock, 315 South Bloomington Street, Streator, Ill. 61364

[21] Appl. No.: 5,946

[22] Filed: Jan. 22, 1987

[51] Int. Cl.[4] ..... B21D 53/24

[52] U.S. Cl. ..... 29/157 C; 29/157 R; 134/167 C; 239/DIG. 13

[58] Field of Search ..... 29/157 C, 157 R, DIG. 26, 29/DIG. 48; 239/DIG. 13; 134/167 C

[56] References Cited

U.S. PATENT DOCUMENTS

| | | | |
|---|---|---|---|
| 2,694,022 | 11/1954 | Schreiner | 134/24 |
| 2,735,794 | 2/1956 | Pletcher | 134/167 C X |
| 3,080,265 | 3/1963 | Maasberg | 134/24 |
| 3,149,784 | 9/1964 | Skidgel | 239/601 X |
| 3,221,184 | 5/1967 | Goss | 254/134.4 |
| 3,246,660 | 4/1966 | Hammelmann | 136/167 C |
| 3,658,589 | 4/1972 | Shaddock | 134/10 |
| 3,744,723 | 7/1973 | Davis | 239/DIG. 13 |
| 4,677,997 | 7/1987 | Strauss | 134/167 C |

OTHER PUBLICATIONS

Brochure Entitled "Pressure" by Adolf Ries, Bruchsal, Germany, dated 6/11/69.

*Primary Examiner*—Timothy V. Eley
*Assistant Examiner*—Frances Chin

[57] ABSTRACT

Self propelling jet nozzles especially suited for cleaning sewer pipes and the like are formed from a tubular body member and a nose cap by machining parallel inner and outer ledges or shoulders inboard from the leading end of the tubular member at a rearwardly inclined angle, drilling a ring of circumferentially spaced bores diverging outwardly from the inner to the outer ledges and tapered toward the outer ledge, securing wear resisting nozzle tubes in the bores in mated relation with the tapered portions thereof and welding the nose cap on the leading end of the tubular body. The trailing end of the body is threaded to receive a water conduit, the nozzle tubes in the bores discharge rearwardly and outwardly around the trailing end of the body to propel the nozzle forwardly. The nose can be provided with one or more passageways discharging forwardly and these passagways can also be provided with wear resisting tubular nozzle inserts. The joining end of the tubular body and nose are tapered to provide a V groove with welding material filling the groove. The outer diameter portion of the tubular body rearwardly from the external ledge is machined to provide a conical neck extending rearwardly and radially outward from the radial inner end of the ledge. This neck conforms with the inclination of the bores so that the jet streams emerging from the nozzle tubes surround but do not impinge against the tubular body.

16 Claims, 2 Drawing Sheets

METHOD OF MANUFACTURING JET NOZZLES

FIELD OF THE INVENTION

This invention relates to the art of manufacturing jet nozzles especially of the self-propelling type useful in sewer pipe cleaning apparatus and more specifically deals with a method of machining body and nose components of jet nozzles to facilitate formation of jet passages which have inner ends larger than their outer ends and wedge lock wear resistant nozzle tubes therein.

BACKGROUND OF THE INVENTION

Self-propelling jet nozzles for sewer pipe cleaning apparatus are disclosed, for example, in the Roland E. Shaddock U.S. Pat. No. 3,658,589, issued Apr. 25, 1972. These prior known nozzles have one piece hollow heads with a ring of rearwardly opening circumferentially spaced nozzle holes of constant diameter throughout their length so that the propelling jet streams do not converge to increase in velocity as they pass through the holes and soon erode and enlarge the holes to decrease the propelling force of the jets.

It would therefore be an improvement in this art to provide a method of making self-propelled jet nozzles for sewer pipe cleaning and the like that permits the formation of circumferentially spaced nozzle bores that have inner ends larger than outer ends and effective to wedge lock wear resistant nozzle tubes in the bores under the action of the high pressure streams of water flowing through the bores.

SUMMARY OF THE INVENTION

According to this invention there is provided an efficient method of manufacturing high pressure water jet nozzles which propel themselves through passageways such as sewer pipes and the like and wash debris from the passage. The method involves machining a thick wall rigid tubular member preferably composed of a noncorroding hard steel. This tubular body, for example, may be about 3" long, has an inner diameter of about 1", and an outer diameter of about 2". A leading end of the body is counterbored to about 1½" for a depth of about ½" while the trailing end is internally threaded to a depth of about 1¼". The counterbore provides an internal shoulder of about ¼" which is machined to form a ledge inclined rearwardly from the radius of the tube. The outer diameter of the tube is then machined to form an external ledge substantially parallel with the inner ledge and a conical neck portion diverging from the radial inner periphery of the ledge to the full diameter of the tube, but inboard from the trailing end of the tube. Diametrically opposed wrench receiving flats are cut into the trailing end of the tube extending about ½" from the trailing end at a depth of about ¼".

A ring of circumferentially spaced bores, preferably six in number, starting from the I.D. of the tube, are drilled through the zone between the inner and outer ledges and extending normal to the zone and thus diverging rearwardly and outwardly. These bores are tapered so that the diameters thereof at the outer ledge are less than the diameters at the inner ledge. Preferably the inner ends of the bores are cylindrical. The large diameter inner ends of these bores preferably open into the inner diameter of the tube inwardly from the inner ledge. The bores surround the conical neck portion of the tube in diverging relation therewith. The inner ends of the bores may have a diameter of about 5/16" with the outer ends having a diameter of about ¼".

Hard wear resisting nozzle insert tubes, preferably formed of tungsten carbide, having tapered outer peripheries mating with the tapered portions of the bores are wedged on and preferably cemented to the bores with an epoxy adhesive. These insert tubes are shorter than the bores and have mouths diverging at an 45° angle from their cylindrical I.D.'s which may be less than ⅛" in diameter.

A nose cap is welded to the leading end of the tubular body covering the counterbore. The cap may have various shapes suited for seeking a path through debris in the passage to be cleared. One or more bores may also be provided in the cap to eject a water jet forwardly to clear a path for the nozzle. The outer diameter of the leading edge of the tubular body and the trailing edge of the nose cap are bevelled so that when the cap is bottomed on the body a peripheral V weld bond groove is provided.

It will, of course, be understood that the above mentioned dimensions may vary widely to suit conditions and are only listed as an example of a best mode embodiment of the invention such as shown on the drawings.

On the Drawings

Figure 1:
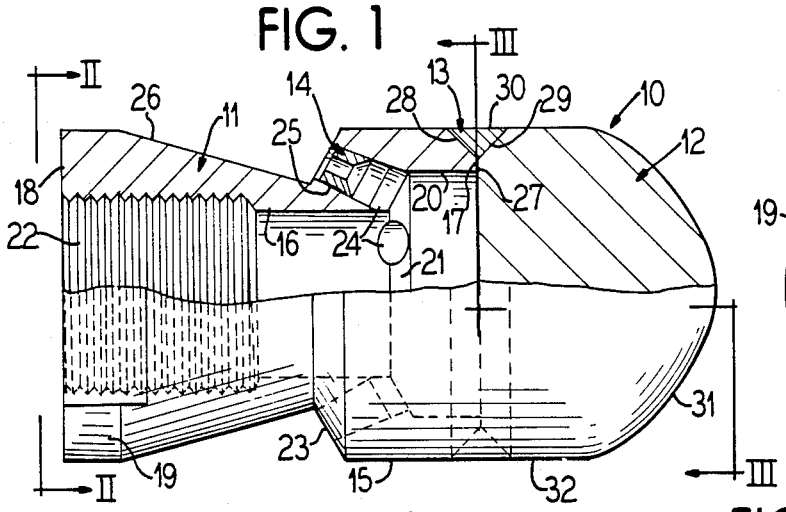
FIG. 1 is a side elevational view, with a portion broken away and shown in longitudinal section of a jet nozzle made by the method of this invention.
Figure 2:
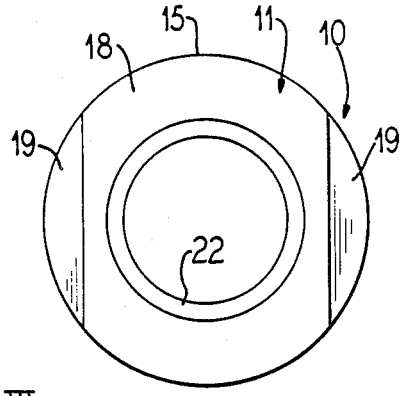
FIG. 2 is a rear end elevational view taken along the line II—II of FIG. 1.
Figure 3:
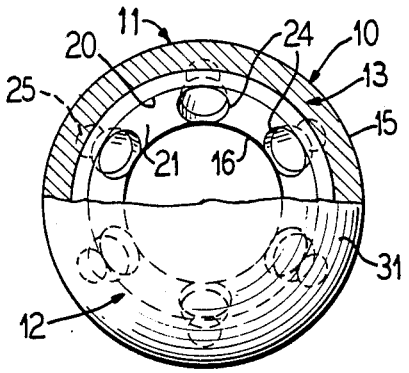
FIG. 3 is a front elevational view, with parts in transverse section taken along the broken line III—III of FIG. 1.

The jet nozzle 10 of FIGS. 1–3 is composed of a tubular member 11, a nose cap 12, a weld bond 13 uniting the cap to the leading end of the body and wear resistant jet nozzle tubes 14 anchored in the body.

The body 11 is a thick wall corrosion resistant metal tube having a cylindrical outer diameter 15, a cylindrical inner diameter 16, a radial leading end face or rim 17, a trailing end face 18, and diametrically opposed wrench receiving flats 19 in the periphery of the trailing end. The leading end of the tube is counterbored at 20 inwardly from the leading end face 17 to a shoulder or ledge 21 with slopes inwardly and rearwardly to the internal diameter 16 of the tube. The interior of the tube is threaded at 22 from the trailing end 18 providing a number of threads to unite the tube to a water conduit.

The outer diameter of the tubular body 11 is machined to provide an outer shoulder ledge 23 generally parallel with the ledge 21 that is spaced rearwardly therefrom to provide a substantial gap therebetween through which is drilled a ring of equally spaced circumferential bores 24. These bores diverge outwardly and rearwardly from the counterbore 20 and have tapered outer ends 25 adjacent the ledge 23 receiving the inserts 14.

The outer diameter of the tubular body 11 is machined to form a conical neck portion 26 extending from the radial inner end of the ledge 23 to the full outer diameter 15 of the tube at the trailing end 18.

The nose 12 is solid and has a flat rear face 27 bottomed on the front face 17 of the body 11. The periphery of the face 17 is rearwardly tapered at 28 and the face 27 is forwardly tapered at 29 with the tapers cooperating to form a V groove around the periphery of the leading end of the body and trailing end of the nose which is filled with a weld bond 30 uniting the nose and body.

The nose cap 12 has a fragmental spherical leading end 31 diverging to a cylindrical outer diameter 32 flush with the outer diameter 15 of the body 11.

The jet nozzle 10 of FIGS. 1–3 thus has an internally threaded trailing end portion for receiving a pipe, a hose or the like, to force water under high pressure into the inner diameter 16 of the body 11 from which it flows into the chamber provided by the counterbore 20 which is blocked by the rear end face 27 of the nose cap 12 so that the water can only escape through the bores 24 into the nozzle jet tube inserts 14. The water is ejected from the inserts in rearwardly opening diverging high pressure streams surrounding the conical portion 26 of the body and these jet streams propel the nozzle through a passage while at the same time backwashing debris in the passage.

The flats 19 receive the jaws of a wrench to facilitate threading of the nozzle onto the water conduit.

Figure 4:
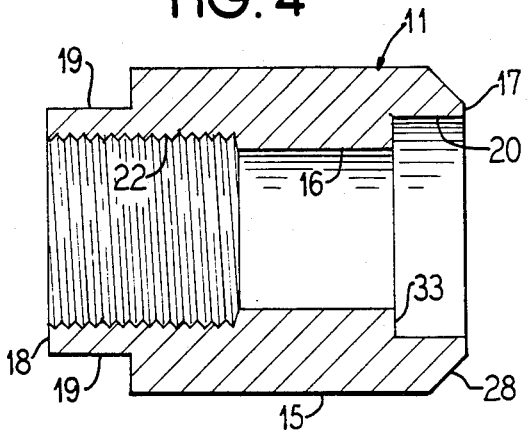
FIG. 4 is a longitudinal sectional view illustrating initial machining steps in forming the body member of the jet nozzle of FIGS. 1–3 according to the method of this invention.

According to the method of this invention, as illustrated in FIG. 4, the counterbore 20 is machined into the leading end 17 of the body member 11 to a flat radial shoulder 33 connecting the counterbore with the inner diameter 16 of the tube. The leading end 17 of the tube is machined to form the taper 28, the trailing end of the tube is internally threaded at 22 with the threads extending from the rear face 18 to the inner diameter 16 and the flats 19 are cut into the outer periphery 15 of the tube at the rear end 18.

Figure 5:
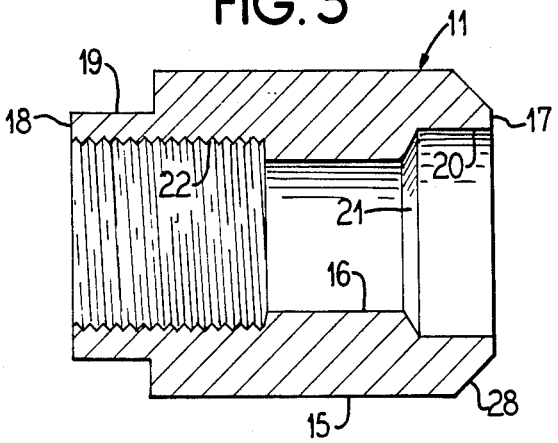
FIGS. 5–7 are views similar to FIG. 4, but illustrating successive machining operations according to the method of this invention.

In a subsequent machining operation illustrated in FIG. 5, the radial shoulder 33 is machined to form the aforesaid inner ledge 21 sloping rearwardly and radially inward from the counterbore 20 to the inner diameter 16.

Figure 6:
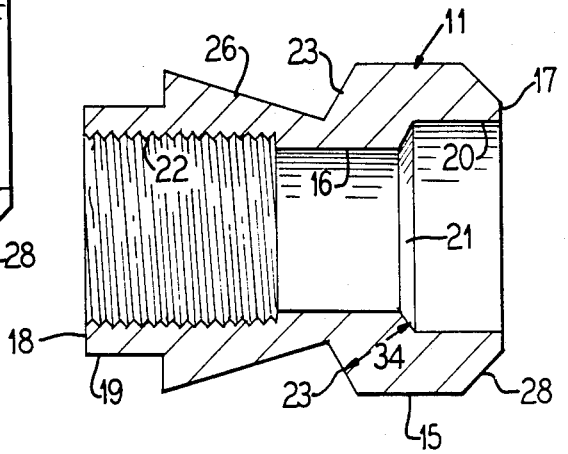

In a further machining operation illustrated in FIG. 6, the outer ledge 23 is cut into the outer periphery 15 of the tube 11 parallel to the inner ledge 21 and spaced a substantial distance therefrom to provide a relatively wide or thick zone 34 therebetween. The outer diameter of the tube 11 is also machined at 26 to form a conical portion between the radial inner end of the ledge 23 and the peripheral portion of the rear end of the tube into which the flats 19 have been cut.

Figure 7:
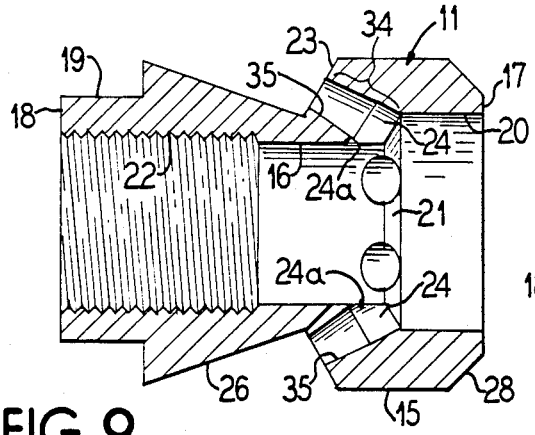

In a still further machining operation illustrated in FIG. 7, the holes 24 are drilled through the zone 34 connecting the ledges 21 and 23. These holes diverge outwardly and rearwardly from the counterbore 20 and their inner ends are cut through the inner diameter 16 as illustrated at 24*a* thereby providing the holes with larger diameters than the width of the tapered ledge 21. These holes 24 have reduced diameter outer ends 35 and the cylindrical inner end portions of the holes converge or taper to the outer end portions whereby the holes have cylindrical inner ends and conical outer ends tapered to the reduced diameter outer ends.

Figure 8:
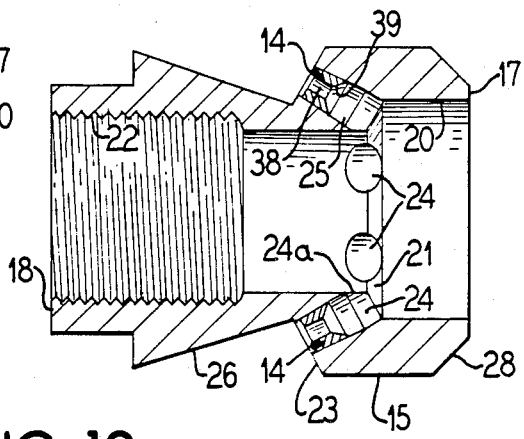
FIG. 8 is a view similar to FIG. 7, but illustrating wear resisting nozzle insert tubes in position in the body member.
Figure 9:
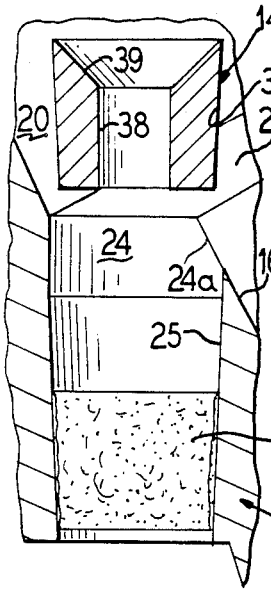
FIG. 9 is an enlarged exploded vertical sectional view illustrating the manner in which the inserts are secured in the bores.

The machined body member 11 of FIG. 7 receives the tubular jet inserts 14, as shown in FIG. 8. As better shown in the enlarged view of FIG. 9, the jet insert tube 14 has a tapered outer periphery 36 mating with the tapered portion 25 of the hole 24 in which it is seated. This tapered outer periphery 36 is cemented in the tapered hole 25 by an epoxy resin 37.

The insert has a cylindrical bore 38 with a tapered inlet mouth 39 diverging from the bore to the hole 24.

It will thus be understood that, in operation of the nozzle 10, the inserts 14 are wedged tightly in the tapered portions 25 of the bore and the high pressured jet streams flowing therethrough cannot eject the inserts from the bores. In addition, of course, the resin cement 37 anchors the inserts 14 in the bores.

The wear resistant insert 14 accommodates the use of relatively large diameter bores 24 for free flow of the high pressure water from the chamber provided by the counterbore 20 into the mouth 29 of the insert where the water flow is accelerated as its path is converged into the reduced diameter tubular passage 38 through the insert.

Since the bores 24 diverge outwardly, the jet streams emerging from the inserts 14 surround the conical portion 26 of the body, but do not impinge thereagainst.

Figure 10:
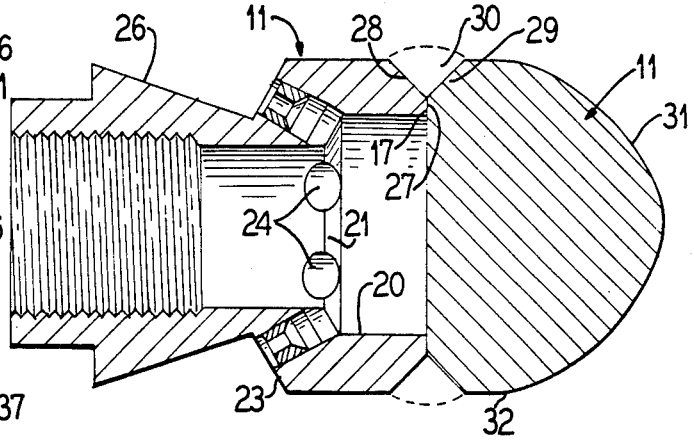
FIG. 10 is a longitudinal sectional view of the machined body member of FIG. 8 with one form of nose cap welded thereon.

As illustrated in FIG. 10, the nose cap 11 is fitted over the finished body 11 with its rear face 27 abutted against the leading face 17 of the body covering the counterbore 20 with the tapered or bevelled faces 28 and 29 confronting each other to provide the groove for the weld bond 30.

Figure 11:
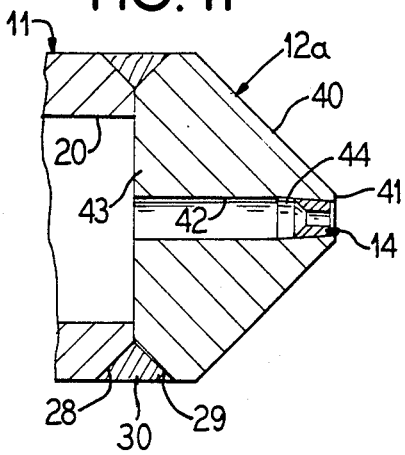
FIG. 11 is a fragmentary view similar to FIG. 10 illustrating a second form of nose cap welded on the body.

As illustrated in FIG. 11, the body 11 may be fitted with a modified nose cap 12*a* which has a conical leading face 40 instead of a spherical face 31. This conical face 40 converges to a flat radial apex 41. A cylindrical bore 42 is drilled axially through the cap 12 from its trailing or base face 43 to the apex 41 and the leading or outer portion of this bore 42 is tapered at 44 to receive and wedge lock an insert 14. This arrangement provides a forwardly discharging jet stream to wash upstream debris in the passage being cleaned.

Figure 12:
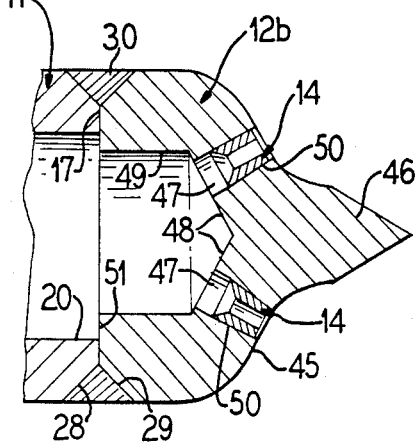
FIG. 12 is a view similar to FIG. 11 illustrating a third form of nose cap welded on the body.

As shown in FIG. 12, a further modified nose cap 12*b* is mounted on the body 11. This end cap has a domed leading face 45 with a central pointed conical spear 46. A pair of cylindrical bores 47 are drilled through the cap diverging radially outwardly and forwardly from an inclined ledge bottom 48 of a counterbore 49 in the back face of the cap. These bores 47 also have tapered front ends 50 wedge fitting inserts 14 therein. The back face 51 of the cap is welded to the front face 17 of the body 11. The counterbore 20 discharges into the counterbore 49 of the cap 12*b* and the bores 47 of the cap transmit water to the inserts 14 for ejecting high pressure water streams forwardly and outwardly around the spear 46.

From the above description it will therefore be clearly understood that this invention provides improved self-propelled jet nozzles by a simplified method utilizing a machined main body tube and a nose cap to accommodate easy formation of tapered nozzles that wedge lock wear resisting nozzle tubes against blow out by the high pressure water streams created by the nozzle.

I claim as my invention:

1. The method of manufacturing high pressure water jet nozzles comprising the steps of providing a tubular elongated first member having a body of substantial wall thickness and leading and trailing ends, machining an inclined angle interior ledge face on an inner diameter thereof inboard from the leading end, the ledge face inclined at an angle to the radial, machining an inclined exterior ledge face on the outer diameter thereof, the exterior ledge face having an angle substantially parallel to the angle of the interior ledge face with the exterior ledge face positioned axially trailing the interior ledge face, forming a plurality of nozzle bores between the interior ledge face and the exterior ledge face opening the interior to the exterior, said bores having a diameter reducing tapered inner diameter section with a smaller diameter adjacent the exterior ledge face and a larger diameter adjacent the interior ledge face, providing a plurality of wear resistant nozzle inserts having outer diameter portions with substantially mating outer diameter surfaces tapered to the tapered inner diameter section of the bores and inner diameter axial bores forming nozzles, securing said inserts in said bores with said tapered surface and section substantially seated against one another, providing an end cap for said first member with a rearward end, and welding said end cap onto the leading end of said first member.

2. The method of manufacturing self-propelling jet nozzles which comprises machining a thick wall metal tube having leading and trailing ends internally to form an annular inclined interior ledge inwardly from a leading end of the tube, machining the tube externally from said interior ledge to form an external inclined ledge downstream from the interior ledge, drilling a ring of circumferential spaced bores with inner and outer ends from the interior ledge through the external ledge, controlling said drilling to provide the bores with tapered portions converging toward the external ledge, inserting wear resistant nozzle tubes through the inner ends of said bores into wedge fitted relation with the tapered portions of the bores, machining the exterior of the tube downstream from the external ledge to provide a clearance relationship between the tube and jet streams emerging from the nozzle tubes, forming a conduit coupling at the trailing end of the tube for uniting the tube to a conduit, and securing a nose cap over the leading end of the tube.

3. The method of manufacturing nozzles for high pressure water conduits to propel the conduits through a passageway which comprises forming a thick wall metal tube with leading and trailing ends and longitudinally spaced inner and outer ledges, forming holes connecting the ledges having large diameters opening through the inner ledge and small diameters opening through the outer ledge, wedging tapered wear resisting nozzle tubes in said holes, forming means in the trailing end of the tube to secure the tube on a water conduit, covering the leading end of the tube with a nose cap, and uniting the nose cap to the tube upstream from the inner ledge.

4. The method of claim 1 including the added step of drilling a bore forwardly through the end cap and wedge fitting a wear resistant jet nozzle tube in the bore of the nose cap.

5. The method of claim 1 including the step of tapering the peripheral portions of the landing end of the first member and the rearward end of the cap to provide a V groove therebetween, and filling said groove with bonding material to unite the first member and cap.

6. The method of claim 1 including the additional step of cementing the inserts in the bores.

7. The method of claim 1 including the additional step of cutting threads in the inner diameter of the first member at the trailing end thereof to couple the body to a conduit.

8. The method of claim 1 including counterboring the first member inwardly from the leading end thereof to form the inner inclined ledge face.

9. The method of claim 2 wherein the machining of the tube externally from the interior ledge is continued to form a radial inner periphery of the external inclined ledge and the machining the exterior of the tube downstream from the exterior ledge is controlled to form a conical neck diverging outwardly and rearwardly from the radial inner periphery of the exterior ledge.

10. The method of claim 2 wherein the drilling is further controlled to extend the bores radially inward beyond the inner ledge to connect the bores with the inner diameter of the tube.

11. The method of claim 2 wherein the forming of the conduit coupling is controlled to provide interior threads in the tube.

12. The method of claim 3 including the step of cementing the tubes in the holes.

13. The method of claim 3 including the step of forming a forwardly opening jet passage through the nose cap.

14. The method of claim 13 including the added step of securing a wear resisting jet tube in the leading end of the jet passage.

15. The method of claim 3 including the step of inclining the ledges rearwardly at an angle to the radius of the tube.

16. The method of claim 15 including the added step of forming the holes normal to the inclined ledges.

* * * * *

UNITED STATES PATENT AND TRADEMARK OFFICE

CERTIFICATE OF CORRECTION

PATENT NO. : 4,764,180

DATED : August 16, 1988

INVENTOR(S) : Roland E. Shaddock

It is certified that error appears in the above-identified patent and that said Letters Patent is hereby corrected as shown below:

In the Abstract, line 18, "ends" should read -- ends --.

Column 6, claim 5, line 15, "landing" should read -- leading --.

Column 6, claim 12, line 42, "co-" should read -- ce- --.

Signed and Sealed this

Ninth Day of May, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,764,180

DATED : August 16, 1988

INVENTOR(S) : Roland E. Shaddock

It is certified that error appears in the above-identified patent and that said Letters Patent is hereby corrected as shown below:

On the title page, after item [76] insert the following:

--[73] Assignee: The Pullman Peabody Company, Princeton, New Jersey--.

Signed and Sealed this

Twenty-third Day of March, 1993

*Attest:*

STEPHEN G. KUNIN

*Attesting Officer*

*Acting Commissioner of Patents and Trademarks*